United States Patent [19]

Foye et al.

[11] 4,214,624

[45] Jul. 29, 1980

[54] METHOD OF AND MOLD FOR DC CASTING

[75] Inventors: John J. Foye, Livermore, Calif.; Jerry F. Harris, Slidell, La.

[73] Assignee: Kaiser Aluminum & Chemical Corporation, Oakland, Calif.

[21] Appl. No.: 954,964

[22] Filed: Oct. 26, 1978

[51] Int. Cl.[2] ..... B22D 11/04; B22D 11/124

[52] U.S. Cl. ..... 164/89; 164/439; 164/440; 164/444

[58] Field of Search ..... 164/82, 89, 418, 439, 164/440, 444

[56] References Cited

U.S. PATENT DOCUMENTS

| | | | |
|---|---|---|---|
| 2,983,972 | 5/1961 | Moritz | 164/89 X |
| 3,563,298 | 2/1971 | Stauffer et al. | 164/418 X |
| 3,780,789 | 12/1973 | Unger | 164/89 X |

*Primary Examiner*—Robert D. Baldwin
*Assistant Examiner*—J. Reed Batten, Jr.
*Attorney, Agent, or Firm*—Paul E. Calrow; Edward J. Lynch

[57] ABSTRACT

This invention is directed to an improved mold bore configuration for a DC casting mold wherein the feed end of the mold bore is provided with a chill section having an inner surface which tapers outwardly in the direction of the discharge end of the mold. The tapered, diverging inner surfaces intersect the surfaces of the straight walled, shape determinative chilled section of the mold bore at an obtuse angle greater than 135°. Faster casting speeds can be used and improved billet and ingot surfaces result.

9 Claims, 6 Drawing Figures

METHOD OF AND MOLD FOR DC CASTING

This invention generally relates to the DC (direct chill) casting of aluminum and other light metals. DC casting is a well-known and widely used process for the continuous and semi-continuous casting of light metal ingot and billet. Casting in the horizontal direction is usually continuous, whereas casting in the vertical direction is usually semi-continuous. In brief, the DC casting process comprises introducing molten metal into the feed end of the open-ended, passageway of a tubular shaped mold, solidifying or partially solidifying the stream of metal in the passageway and withdrawing solidified or partially solidified metal from the discharge end of the mold passageway. Most modern DC casting facilities utilize a concentric jacket around the mold in order to maintain a cooling body of water on the back side of the mold and also to direct this water onto the ingot or billet as it emerges from the discharge end of the mold. Quite frequently a baffle is positioned within the chamber defined by the mold body and water jacket to direct coolant from within the chamber along the length of the backside of the tubular mold in the direction of the discharge end and through suitable openings onto the emerging ingot or billet. Many casting facilities introduce lubricant continuously around the inner periphery of the feed end of the mold.

FIG. 1 is a simplified schematic drawing showing a typical prior art mold and is identified as such. When the molten metal is introduced into the feed end of the mold, a thin layer of metal immediately adjacent to the water cooled mold wall is rapidly chilled and solidified. As cooling and thus solidification continues, the stream of metal contracts and pulls away from the mold wall. This thin shell or embryo of solidified metal is initially quite fragile and care must be exercised during casting to avoid tearing or any other excessive deformation thereof. Solidification of the metal continues inwardly toward the center of the metal stream as it proceeds through the mold passageway. When the metal stream exits from the mold in the form of a solidified or partially solidified ingot or billet, coolant is applied to the surfaces thereof.

Once the metal embryo or shell shrinks and pulls away from the chill surfaces of the mold bore, relatively little heat removal is effected through the mold walls. Most of the heat removed for solidification is removed by the application of coolant onto the metal stream as it emerges from the discharge end of the mold. This axial type of heat removal is commonly misnomered "upstream conduction".

Since its inception, the DC casting process has produced ingots and billets which usually required scalping to remove surface defects prior to subsequent processing such as rolling. DC cast extrusion billets were usually not scalped but used as is. However, a large amount of the billet was left unextruded in the extrusion chamber to prevent any surface defects on the billet, which are highly oxidized, from being extruded into the final product.

Many of the surface imperfections of DC cast products can be traced to the problems of bleeding (liquation) or cold folding (cold shutting). Liquation or bleeding results from the seeping or exudation of molten metal through the thin solidified embryo and the solidification of this molten metal on the embryonic surfaces. Cold shutting or cold folding involves the periodic lapping of molten metal over the metal embryo or shell and the solidification thereof, resulting in a series of ringed depressions around a portion or all of the ingot or billet. These casting problems usually relate to the broad temperature differential between liquidus and solidus temperatures of highly alloyed metal. Relatively pure alloys such as 1100 or 1350 (Aluminum Association Alloy Designations) can be readily cast with few surface defects.

As previously mentioned, the initial solidification of the embryo or shell is very rapid. If the temperature of the molten metal fed to the mold is too high or if the heat extraction through the mold walls and from upstream conduction is too slow, highly alloyed metal, which has a low melting point, can remelt at the surface or flow through the dendritic interstices to the surface resulting in the liquation or bleeding previously described. On the other hand, if the heat removal is too rapid, the solidification of the embryo or shell can proceed too far up the mold bore resulting in the lapping of molten metal over this solidified shell to form a cold shut or cold fold. In practice, an appropriate balance between heat input and removal generally must be developed to avoid liquation or bleeding on the one hand and cold folds or shuts on the other. However, even when a proper balance is attained, the surface of the resultant ingot or billet will frequently require substantial scalping to remove surface defects prior to subsequent processing. Surface unevenness and other defects can be due to such factors as changes in the head of the metal in the mold, differential heat transfer around the periphery of the mold caused, for example, by variations in lubricant thickness or lubricity, or abrupt changes in the discharge rate or the discharge angle of the metal stream exiting the mold.

In commercial practice, a mold can generally be designed for a particular alloy composition which will cast an ingot or billet having an acceptable surface, provided that effective processing control is maintained during casting. However, such a mold under most circumstances will not effectively cast other alloy compositions having significantly different solidus and liquidus temperatures. It is not practical in most casting facilities to maintain a large inventory of molds to cast each of the various alloys in all of the sizes desired.

Much progress has been made over the years to minimize the aforementioned surface defects associated with DC cast ingot and billet, but, although the severity of many of these problems has been reduced, they still remain.

Recently, the suggestion has been made to further minimize surface defects by utilizing a DC casting mold wherein the feed end of the mold is provided with a short chill section which has a slightly smaller cross section or diameter than the remaining portion of the mold bore. A partial cross section of such a mold is shown in FIG. 2. In casting with such a mold, the molten metal contacts the chill surfaces of the smaller diameter mold bore section to initially form a thin solidified embryo or shell as in conventional DC casting. However, due to the metallostatic head of molten metal contained by the embryo or shell and the thinness of the shell or embryo at this point, the metal stream expands as it passes into the larger diameter section of the mold bore. In the larger diameter section the molten metal contacts the chill surfaces to further solidify the embryo or shell, and the metal stream then shrinks away from the mold surfaces. Further solidification follows in a conventional fashion.

This modified mold bore design, herein identified as a "step mold", resulted in a substantial reduction in the severity of surface defects characteristic of the prior DC casting processes with small diameter billet. However, in casting the larger sized ingot and billet, comet-like surface depressions appeared on the cast metal surface. These comet-shaped depressions could be minimized to a certain extent by severely reducing the amount of lubricant applied to the mold bore, but, at the lowered lubricant levels required, the thin shell would frequently stick to the mold bore. Due to the fragile nature of the solidified embryo or shell, any sticking usually causes a tearing of the embryo or shell which results in severely deformed billet or ingot surfaces. These surface defects, particularly in the larger sized ingot and billet, negated most of the improvements which resulted from the use of this mold bore design.

Against this background the present invention was developed.

Figure 1:
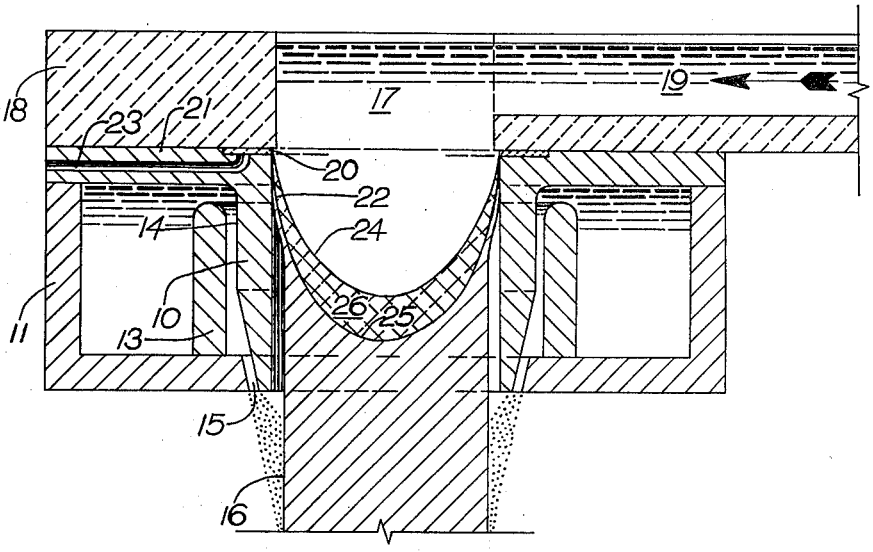
Fig-1 PRIOR ART
FIG. 1 is a cross sectional view of typical prior art mold assembly.

This invention relates to the DC casting of metals in an open ended, tubular shaped mold and in particular is directed to a novel mold bore design. In accordance with the invention a chill section is provided in the mold bore having a tapered or chamfered inner surface which diverges in the direction of the discharge end of the mold. This chill section is designed to direct the molten metal within the mold passageway into the final straight walled chill section which controls the shape of the solidified or the partially solidified metal discharged from the mold. Generally, the chill section having the divergent inner surface is located at or near the feed end of the mold, and, in a preferred embodiment, it is the first chill section that molten metal contacts as it enters the mold bore. It may be desired, particularly with smaller sized molds, to provide a short straight walled chill section in the feed end before the chill section having the divergent inner surface.

The mold bore configuration of the invention allows for the casting of a wide variety of alloy compositions with substantially improved surface characteristics even over the stepped mold configuration previously described. Moreover, the comet-like depressions or the surface tearing which were characteristic of the prior step molds, particularly in the larger sizes, do not occur with the mold bore of the invention throughout a wide range of lubricant flow rates. Substantially increased casting rates can be used with essentially no detrimental effects on surface.

As used herein, the expression "chill section" or "chill surface" refers to a highly conductive mold section or surface for containing the molten metal and the cooling thereof which has a thermal conductivity in excess of 500 BTU/ft$^2$/hr/°F. (620 cal/cm$^2$/hr/°C.) at the operating temperature. Moreover, the chill section or surface, to be such, must not be thermally insulated in any manner from the coolant (usually water) which is maintained on the back side of the mold. Suitable materials for construction of the chill sections include aluminum, copper and graphite, although for aluminum and aluminum alloys, aluminum chill sections are preferred.

Insofar as the chill section having the inner divergent surface (sometimes referred to herein as chamfered or tapered chill section) is concerned, the length thereof (as measured parallel to the mold axis) is from 0.05 inch (0.127 cm) to less than 0.5 inch (1.27 cm) and is preferably less than 0.4 inch (1.02 cm). The radial dimension of the smaller end of this chill section is from about 0.005 to about 0.1 inch (0.013 to 0.254 cm) preferably 0.01 to 0.06 inch (0.025 to 0.152 cm) less than the equivalent radial dimension of the larger end which intersects the straight walled section. The inner diverging surface of the tapered chill section intersects the inner surface of the straight walled, shape determining chill section at an obtuse angle greater than 135° preferably greater than 145°. At intersect angles less than 135° the mold will usually operate in essentially the same mode as prior step molds. At intersect angles greater than 170° the mold will operate as a conventional straight walled mold.

The chamfered chill section can, if desired, be preceded at the feed end by a straight walled chill section but the length thereof should not exceed 0.5 inch (1.27 cm), preferably not more than 0.4 inch (1.02 cm). This latter embodiment is sometimes attractive in casting billet less than 10 inches (25.4 cm) in diameter.

The chamfered or tapered chill section may be preceded by a plurality of chill sections comprising a tapered or chambered chill section followed by a straight walled chilled section. The requirements for these various chill sections follow the requirements previously described. Additionally, the total length of these preceding chill sections should not exceed 0.5 (1.27 cm), preferably not more than 0.4 inch (1.02 cm). This embodiment of the invention may be attractive for casting of large diameter billet, e.g., 16 to 20 inches (40.6 to 50.8 cm) in diameter, particularly hard to cast aluminum alloys such as 6101 alloy.

The final essentially straight-walled chill zone which follows the chamfered chill zone controls the shape of the solidified or partially solidified metal discharged from the mold. The length of this section is generally unimportant to the general concepts of the present invention. However, to be consistent with modern DC casting technology, it is preferred to maintain the final chill section as short as possible.

The mold bore design of the invention allows for the casting of a broad spectrum of alloy compositions having widely varying differentials between the liquidus and solidus temperatures, yet provides substantially improved ingot or billet surfaces, improved even over the step mold configuration previously discussed.

In the operation of the mold in accordance with the invention, as molten metal contacts the chill surfaces of the chamfered section a thin embryo or shell forms immediately if it had not already been formed in preceding chill sections. However, due to the thin, elastic nature of the embryo or shell at this point and the metallostatic head of molten metal behind the embryo or shell, no significant contraction of the metal stream occurs. As the metal stream passes through the chamfered chill section it expands until it contacts the final chill section of the mold which controls the shape of the metal which is discharged from the mold. It is believed that the chamfered mold bore section of the invention allows for a smooth transition to the larger diameter chill section without detrimentally affecting the fragile embryo. There are no sharp breaks in the mold passageway as there are in the prior step molds and therefore there is no place for lubricant to build up, which is believed to cause, at least in part, the comet-like surface defects previously described. The chamfered chill section allows an adequate amount of lubricant to be fed along the entire effective length of the mold bore even at low lubricant flow rates so that tearing of the thin embryonic shell caused by hand-ups on the mold wall is essentially eliminated.

With the mold design of the invention the casting rate must not be so slow that the embryo or shell formed in the smaller cross sections of the mold is solidified to such an extent that the metal stream is incapable of expanding in the larger diameter final chill section. In accordance with the invention the metal stream must expand to contact the mold walls in the larger, shape determining chill section to effect the improved surfaces characteristic of this mold design. Conversely, the casting rate must not be so rapid that there is essentially no embryo or thin shell formation before passing out of the chamfered section. To cast metal in accordance with the invention, the shell or embryo in the chamfered chill section must be sufficiently strong to prevent any tearing thereof yet it must not be so strong that essentially no contact is made with the larger diameter section of the mold. The mold bore contact necessary for the invention is readily determined by the nature of the product exiting from the discharge end of the mold. An additional method for determining this adequate contact is to paint a narrow longitudinal segment of the mold bore with a bluing dye prior to casting and then checking the mold bore after casting one or more billets or ingots. Those areas from which bluing dye has been removed indicate metal contact.

The casting rate is controlled by controlling the drop rate of the bottom block in vertical DC casting and by controlling the rate of rotation of pinch rolls and the like in horizontal DC casting. Other methods can obviously be used.

Reference is made to the drawings which illustrate both the prior mold designs and those which exemplify the invention. It should be noted that the contraction of the metal stream shown in the drawings is exaggerated for purposes of illustration. In the drawings all corresponding parts are numbered the same.

FIG. 1 is a cross sectional view of a typical prior art DC casting mold assembly comprising a flanged, open ended tubular mold body 10 surrounded by water jacket 11. A baffle 13 is provided for directing the coolant from the chamber defined by the mold body 10 and the water jacket 11 down the back side 14 of the mold (to increase heat transfer in that area) and then out through annular slot 15 onto the emerging ingot 16. The mold assembly shown in this figure is commonly termed a "level feed" mold assembly in that a body of molten metal 17 is maintained above the mold by means of a refractory header 18 and molten metal is introduced into refractory header 18 via trough 19 at essentially the same level as the metal 17. A slotted gasket 20 is provided between the refractory header 18 and the mold flange 21 to introduce lubricant to the mold bore 22. Lubricant is supplied to gasket 20 through conduit 23.

Line 24 illustrates in an idealized fashion the liquidus isotherm at which point metal begins to solidify and line 25 illustrates the solidus isotherm at which point the metal is completely solidified. The body of metal 26 between the two lines is in a partially solidified or mushy state and it becomes increasingly solidified as it approaches the solidus isotherm. In casting relatively pure metals, lines 24 and 25 will be quite close, whereas with highly alloyed metal the distance between them will be much greater.

Figure 2:
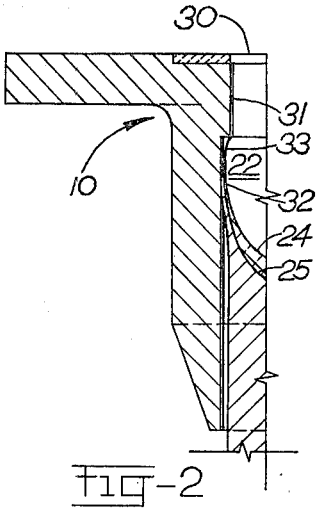
Fig-2 PRIOR ART
FIG. 2 is a cross sectional view of a modified mold body suitable for use in assembly shown in FIG. 1 which is also identified as prior art.

FIG. 2 represents a partial, cross sectional view of a mold body 10 which is suitable for use in the assembly shown in FIG. 1 and which is provided with a step mold bore configuration. The feed end 30 of the mold bore 22 has a first chill segment 31 with a smaller diameter than that of the following chill section 32 which controls the final shape of the metal. In a typical operation of this mold configuration, the molten metal begins to solidify to form the embryo 33 as soon as it contacts the chill section 31. However, because the embryo or shell 33 is very thin and flexible and due to the reheating of the shell 33 by the molten metal contained by the shell, it expands as it enters the larger chill section 32. Upon contacting the surface of chill section 32 the metal stream shrinks away from the mold wall and completes the solidification in a conventional manner.

Figure 3:
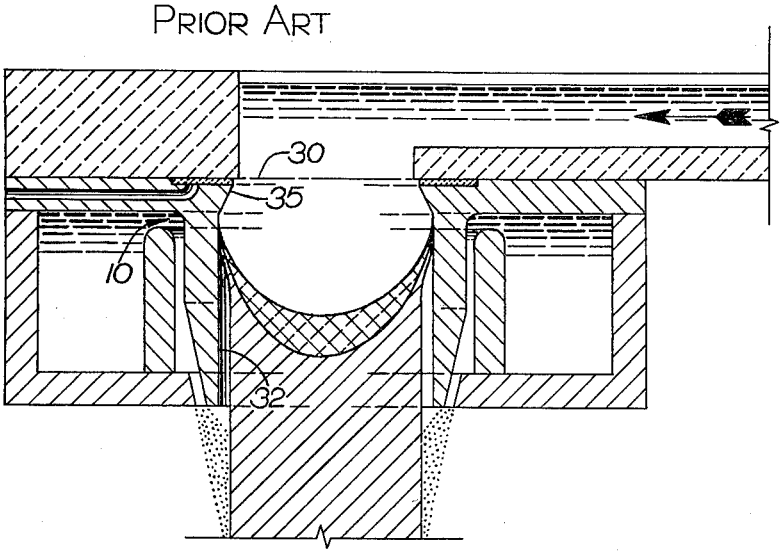
FIG. 3 is a cross sectional view of a mold assembly with a mold body representing a preferred embodiment of the invention.

FIG. 3 is a cross sectional view of a mold assembly which represents a preferred embodiment of the invention. In this preferred embodiment, mold body 10 is provided with a tapered or chamfered chill section 35 located at the feed end 30 having an inner surface which flares out or diverges in the direction of the discharge end of the mold. The chill section 35 is concentric with the following straight walled chill section 32 and the intersecting surfaces of these two chill sections form an obtuse angle greater than 135°. The straight walled section 32 controls the shape of the metal stream which is ultimately discharged from the mold.

Figure 4:
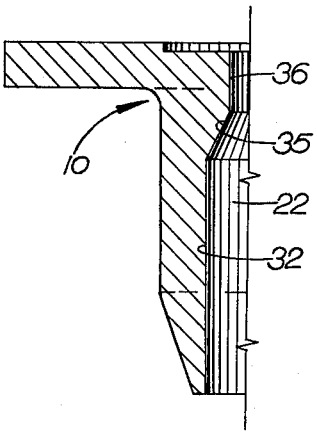
FIGS. 4 and 5 are partial cross sectional views of other embodiments of the invention.

FIG. 4 is a partial cross section of a mold body 10 which illustrates an embodiment of the invention which can be used in casting relatively small billet, i.e., less than 10 inches in maximum cross sectional dimension. It is suitable for use in the mold assembly shown in FIGS. 1 and 3. The mold bore of FIG. 4 is similar to that shown in FIG. 3 except that the chamfered chill section 35 is preceded by a straight walled chill section 36 having the same cross sectional dimensions as the smallest portion of the chamfered section 35.

Figure 5:
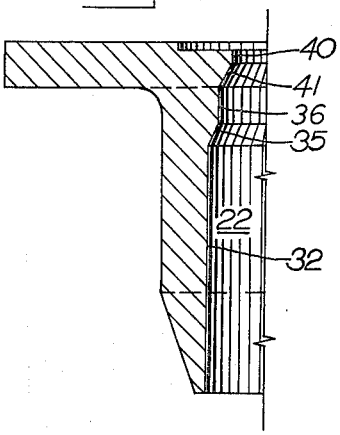

FIG. 5 represents an embodiment wherein additional straight walled and chamfered chill sections 40 and 41 respectively precede the final chamfered chill section 35 and the shape determinative chill section 32.

Figure 6:
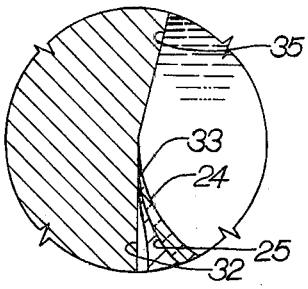
FIG. 6 is an enlarged partial cross sectional view of the mold body shown in FIG. 3.

FIG. 6 represents the junction of chill sections 35 and 32 and illustrates the solidification of the metal in accordance with the invention. The metal shell or embryo 33 gradually expands as the metal passes through the chamfered section 35. Upon contacting the straight walled chill section 32 the metal shrinks away from the chill surfaces to the final shape which is discharged from the mold. The embryo 33 may contract slightly in the chamfered zone 35 or in one of the preceding chill zones, but, when the metal stream loses contact with the chill surfaces, the molten metal contained by the embryo 33 reheats the shell so that it can expand to again contact the final chill surface 32 which controls the final shape of the metal stream.

The following examples are provided to further illustrate various aspects of the invention. The first two examples illustrate the casting of aluminum with prior mold designs whereas Examples 3, 4 and 5 illustrate the operation of mold designs in accordance with the invention. In all of the examples aluminum molds were employed.

EXAMPLE 1

A melt of 6063 aluminum alloy (Aluminum Association alloy designation) was prepared in a laboratory furnace having a capacity of about 20,000 pounds (9072 kg) of molten metal. Composition of the melt was as follows:

| Si | Fe | Cu | Mn | Mg | Cr | Zn | Ti | Al |
|---|---|---|---|---|---|---|---|---|
| .44 | .22 | .033 | .003 | .48 | .002 | .043 | .027 | Bal. |

After fluxing, the molten metal at about 1350° F. (732° C.) was directed to a conventional level fed, water jacketed DC casting mold assembly as shown schematically in FIG. 1. The straight walled mold bore had a diameter of about 10 inches (25.4 cm) and a length of about 2.625 inches (6.668 cm). During casting approximately 1.0 ml per minute of a lubricant (castor oil) was continuously applied to the mold bore through a slotted gasket provided between the mold flange and the refractory header. The casting rate was varied from about 1 to 4 inches (2.54 to 10.2 cm) per minute in order to determine the surface characteristics of the cast billet. At the low casting rates the surfaces of the billet were characterized by heavy cold folding and slight indications of liquations. However, as the casting speeds were increased the surfaces of the billet gradually changed to heavy liquations and slight indications of cold folding. At a casting rate of approximately 2.25 inches (5.72 cm) per minute relatively good commercial quality billet was produced, but the billet evidenced some cold folding and liquations as well as other minor surface defects.

EXAMPLE 2

Another melt of 6063 aluminum alloy was prepared in the same laboratory facilities described in Example 1 except that the metal was cast in a step mold assembly as shown schematically in FIG. 2. The feed end of the nominal 10 inch (25.4 cm) diameter mold bore was 0.015 inch (0.038 cm) smaller in radius than the remainder of the mold bore. The length (measured axially) of this smaller feed end section was 0.4 inch (1.02 cm). The total length of the mold bore was 2.625 inches (6.668 cm). The alloy composition of the molten metal was as follows:

| Si | Fe | Cu | Mn | Mg | Cr | Zn | Ti | Al |
|---|---|---|---|---|---|---|---|---|
| .41 | .19 | .035 | .003 | .45 | .002 | .05 | .027 | Bal. |

After fluxing, the molten metal at 1365° F. (741° C.) was directed to the mold. Several billets were cast at drop rates ranging from about 1 to 3.3 inches (2.54 to 8.38 cm) per minute and lubricant (castor oil) flow rates ranging from about 0.5 to 1.0 ml per minute. At the higher lubricant flow rates the billet surface showed very little evidence of cold folding or liquation and was much better in this regard than billet cast in conventional level fed molds. However, there were periodic formations of comet-like depressions on the surface of the billet.

EXAMPLE 3

Another melt of 6063 aluminum alloy was prepared and cast at the laboratory facilities described in the previous examples except that the metal was cast in a 16 inch (40.6 cm) diameter mold in accordance with the invention as shown schematically in FIG. 3. The chamfered section at the entry end of the mold had a radius of about 0.03 inch (0.08 cm) less than the straight walled sections of the mold bore and the axial length of this chamfered section was about 0.270 inch (0.686 cm). The composition of the metal was as follows:

| Si | Fe | Cu | Mn | Mg | Cr | Zn | Ti | Al |
|---|---|---|---|---|---|---|---|---|
| .38 | .18 | .035 | .003 | .47 | .002 | .001 | .009 | Bal. |

After fluxing, the molten metal at 1365° F. (741° C.) was fed to the mold. Several billets were cast at drop rates ranging from about 1.5–2.0 inches (3.8 to 5.1 cm) per minute and with a lubricant (castor oil) flow rate ranging from about 1 to 2.5 ml per minute. Generally the surfaces of the resultant billet were outstanding with no evidence of any significant cold folds, liquations or comet-like depressions.

EXAMPLE 4

Another melt of 6063 aluminum alloy was prepared in the same laboratory facilities described in Example 1 except that the metal was cast in a mold in accordance with the invention as shown schematically in FIG. 4. The straight walled chill section at the feed end of the mold bore had a radius approximately 0.015 inch (0.038 cm) smaller than the radius of the final chill section. A chamfered section of about 0.06 inch (0.15 cm) in length was provided between the smaller bore chill section at the feed end and the remaining portions of the mold bore. The composition of the molten metal was as follows:

| Si | Fe | Cu | Mn | Mg | Cr | Zn | Ti | Al |
|---|---|---|---|---|---|---|---|---|
| .44 | .19 | .030 | .003 | .45 | .001 | .017 | .025 | Bal |

After fluxing, the metal at 1365° F. (741° C.) was directed to the mold described above. Several billets were cast at various drop rates from about 1 to 4 inches (2.54 to 10.2 cm) per minute and lubricant (castor oil) flow rates from about 1.0 to 0.6 ml per minute. At the higher lubricant flow rates no comet-like depressions were found on the surface of the billet but it was obvious during casting that an excessive amount of lubricant was employed. Under all conditions tested the billet had better surface properties than those cast under similar conditions on a conventional level fed mold or a level fed step mold, as described in Examples 1 and 2.

EXAMPLE 5

A commercial casting station was converted to employ the mold designs of the invention. The casting station had the capacity of handle up to about forty 6-inch (15.24 cm) diameter molds and up to twenty 12-inch (30.5 cm) diameter molds. Over a 3-month test period, various alloys such as 1100, 6061, 6063 and 6101 alloys were cast in sizes ranging from 4 to 12 inches (10.2 to 30.5 cm) in diameter. The surfaces of the billets cast during this test period were outstanding and believed to be the best billet surfaces heretofore consistently obtained from any commercial DC casting station. Overall metal recovery from this casting station exceeded 93% and billet recover exceeded 95%. Of particular note was the results of casting difficult-to-cast 6101 aluminum alloy. Prior to the installation of the molds of the invention overall metal recovery frequently ranged from 60 to 70% for this alloy. With the molds of the invention recoveries exceeded 90%.

For ease of discussion the molds of the invention generally have been described herein in terms which imply that the molds have a circular cross section. However, it is obvious that the molds can have any suitable cross section including square or rectangular. Thus, the surface of the chamfered chill section of the mold having a circular cross section will define a truncated cone or frustum whereas one with a square cross section will define a truncated pyramid.

Other modifications can be made to the invention without departing from the spirit thereof or the scope of the appended claims.

We claim:

1. In an open ended, tubular shaped DC casting mold having a feed end for receiving molten metal, a passageway having a straight walled chill section for solidifying or partially solidifying molten metal received into the final shape and a discharge end for discharging the solidified or partially solidified metal, the improvement comprising a chill section in said passageway preceding said straight walled chill section having an inner surface which diverges in the direction of the discharge end and which intersects said inner surface of the straight walled section at an obtuse angle greater than 135° said divergent surface having an axial length of about 0.05 inch (0.127 cm) to less than 0.5 inch (1.27 cm) and a minimum radial dimension of about 0.005 to 0.1 inch (0.013 to 0.25 cm) less than equivalent radial dimension of the divergent inner surface which intersects the following straight walled chill section.

2. The casting mold of claim 1 wherein the passageway is provided with a second straight walled chill section which precedes the chill section having the inner divergent surface and which has an inner surface which intersects and is concentric with the inner divergent surface thereof.

3. The casting mold of claim 1 wherein the obtuse angle is greater than 145°.

4. The casting mold of claim 1 wherein the chill section having the divergent inner surface is disposed at the feed end of said mold.

5. The mold of claim 2 wherein the length of the straight walled chill section preceding the chill section having the divergent inner surface is less than 0.5 inch (1.27 cm).

6. The mold of claim 1 wherein the chill section having the divergent inner surface is preceded by one or more chill sections each having a segment having an inner surface which in part diverges in the direction of the discharge end of the mold and a part which is parallel with the mold axis.

7. The mold of claim 1 wherein the axial length of the chill section having the inner divergent surface is less than 0.4 inch (1.02 cm).

8. The mold of claim 1 wherein the minimum radial dimension of the divergent inner surface is about 0.01 to 0.06 inch (0.025–0.152 cm) less than the equivalent radial dimension of the divergent inner surface which intersects the following straight walled chill section.

9. A method of DC casting light metal in an open ended, tubular shaped mold provided with a passageway between a feed end and a discharge end thereof, said passageway having a first chill section with an inner surface which diverges in the direction of the discharge end of the mold, followed by a second straight walled chill section concentrically disposed with respect to the first chill section, the diverging inner surface of the first chill section intersecting with the inner surface of the second chill section at an angle greater than 135°, said method comprising:

(a) continuously introducing lubricant around the inner periphery of said passageway at the feed end thereof;

(b) introducing molten metal into the first chill section;

(c) controlling the passage of molten metal stream through the first chill section so that a thin, expandable embryo of solidified metal forms adjacent to the diverging surface of the first chill section and the metal stream expands it passes through the first chill section and into the second straight walled chill section wherein the metal is solidified or partially solidified into the desired cross section, said passage avoiding the buildup or maintenance of a body of lubricant at the intersection of said first and second chill sections by the contacting of the intersection with the solidified metal embryo;

(d) withdrawing the solidified or partially solidified metal from the discharge end of the molt and applying coolant onto the surfaces of said stream to effect complete solidification thereof.

* * * * *

UNITED STATES PATENT AND TRADEMARK OFFICE

CERTIFICATE OF CORRECTION

PATENT NO. : 4,214,624

DATED : July 29, 1980

INVENTOR(S) : John J. Foye and Jerry F. Harris

It is certified that error appears in the above-identified patent and that said Letters Patent are hereby corrected as shown below:

Column 8, line 62, "of" should be --to--

Column 10, line 39, "expands it" should be --expands as it--

Column 10, line 48, "molt" should be --mold--

Signed and Sealed this

*Fourth* Day of *November 1980*

[SEAL]

*Attest:*

SIDNEY A. DIAMOND

*Attesting Officer*

*Commissioner of Patents and Trademarks*